United States Patent [19]

Urasaki

[11] 4,363,479

[45] Dec. 14, 1982

[54] MAGIC CONTAINER

[76] Inventor: Tatsuo Urasaki, 4-58-7, Narashinodai, Funabashi-shi, Chiba-ken, Japan

[21] Appl. No.: 261,920

[22] Filed: May 8, 1981

[51] Int. Cl.[3] ..... A63J 23/00

[52] U.S. Cl. ..... 272/27 N; 40/19; 40/406; 215/6

[58] Field of Search ..... 46/1 D, 11; 272/8 R, 272/8 N, 27 R, 27 N, 27 W; 215/1 R, 6, 317; 40/406, 407, 306, 19

[56] References Cited

U.S. PATENT DOCUMENTS

| | | | |
|---|---|---|---|
| 652,994 | 7/1900 | Butler | 272/27 R |
| 747,123 | 12/1903 | Bourke et al. | 272/27 R |
| 978,681 | 12/1910 | Walther | 272/27 R |
| 1,030,859 | 7/1912 | Anagnostou | 272/8 R |
| 1,044,719 | 11/1912 | Wineman | 215/6 |
| 1,775,747 | 9/1930 | Ake | 272/27 N |
| 2,621,430 | 12/1952 | Neville | 40/406 X |
| 2,763,142 | 9/1956 | Hepner | 40/406 X |
| 3,862,614 | 1/1975 | Kovac | 215/317 |

FOREIGN PATENT DOCUMENTS

| | | | |
|---|---|---|---|
| 356580 | 7/1922 | Fed. Rep. of Germany | 272/27 R |
| 1023384 | 1/1958 | Fed. Rep. of Germany | 272/8 R |
| 2210786 | 9/1973 | Fed. Rep. of Germany | 272/27 N |

*Primary Examiner*—F. Barry Shay

*Attorney, Agent, or Firm*—Bernard, Rothwell & Brown

[57] ABSTRACT

A magic container for containing beverages such as soft drinks and alcoholic drinks. The wall of the container contains a conduit which communicates the interior with the exterior. The inlet port and the outlet port of the conduit are formed at the lower portions of the container. The conduit starts from the inlet port, runs through the rising portion, the uppermost portion and the descending portion, and reaches the outlet port which is located at a position lower than the inlet port. After the use, for example, at a resort, the container can be utilized as a toy to be played with by children or as an implement for scientific experiments.

3 Claims, 3 Drawing Figures

MAGIC CONTAINER

BACKGROUND OF THE INVENTION

1. Field of the Invention

This invention relates to a container, and more specifically to a container for containing beverages that can be served by simply removing the cover of the container as required. According to this invention, the container after use can be used as a magic container.

2. Description of the Prior Art

In recent years, disposable containers have been very commonly used for containing sake and cool beverages. The disposable containers, however, present a serious problem of contaminating the environment. Although various attempts have been made to eliminate the above problem of environmental pollution, there has yet been found no effective measure. In Japan and in the U.S., for example, the move is increasing year after year to legislate a so-called "Regulation related to Used Cans" which enforces the distributors and the manufacturers to recover the used cans, in order to protect the environment from being polluted. At the present time, however, the industries resist against such Regulations so fiercely that arguments have been deployed between the side of the industries and the side of the groups for protecting the environment and consumer's groups.

SUMMARY OF THE INVENTION

The principal object of this invention therefore is to provide a container which helps prevent the environment from being contaminated.

Another object of this invention is to provide a container which also serves as a magic container in addition to the function of the container.

A further object of this invention is to provide a container which also serves as a medium of advertisement in addition to the function of the magic container.

DESCRIPTION OF THE PREFERRED EMBODIMENTS

Figure 1:
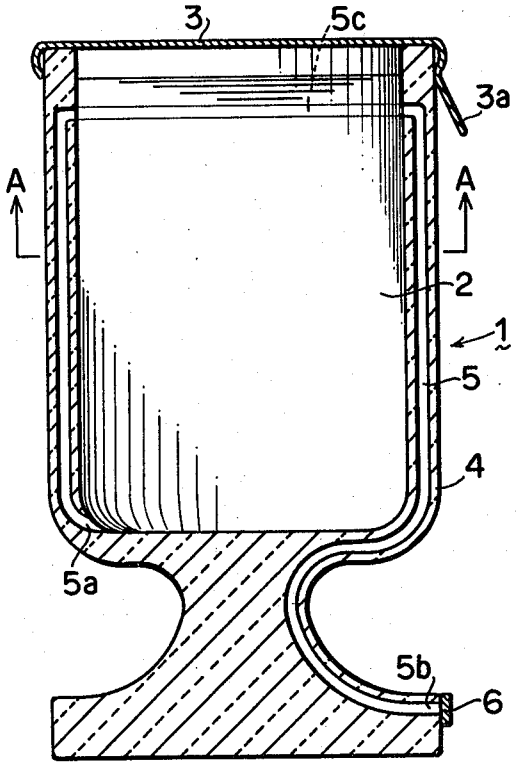
FIG. 1 is a vertical cross-sectional view illustrating a container according to an embodiment of this invention.

FIG. 1 shows a container containing a cool beverage such as Coke or the like. The cool beverage 2 is contained in a container 1 made of a plastic material, and is sealed by a cover 3 made of a plastic material or aluminum. A narrow cavity or conduit 5 is formed in a wall 4 of the container 1 so that the liquid is allowed to flow out. One end 5*a* of the conduit 5 is communicated with the interior of the container 1 and another end 5*b* is communicated with the exterior. As mentioned in further detail, the ends 5*a* and 5*b* of the conduit 5 are formed in the bottom portions of the container 1, the inlet port 5*a* being located at a position higher than the outlet port 5*b*. The conduit 5 runs through the wall 4 of the container 1. Namely, the conduit 5 upwardly rises starting from the end 5*a*, runs through a top portion 5*c* which has the height of about 80% the height of the container 1, and then descends to reach the other end 5*b*. A seal 6 has been stuck to the outlet port 5*b* which is the other end formed in the outer peripheral portion of the container 1, so that the cold beverage 2 will not flow out.

A person who wishes to drink the cold beverage 2 will pull up a tongue piece 3*a* of the cover 3 to open the cover 3.

Figure 3:
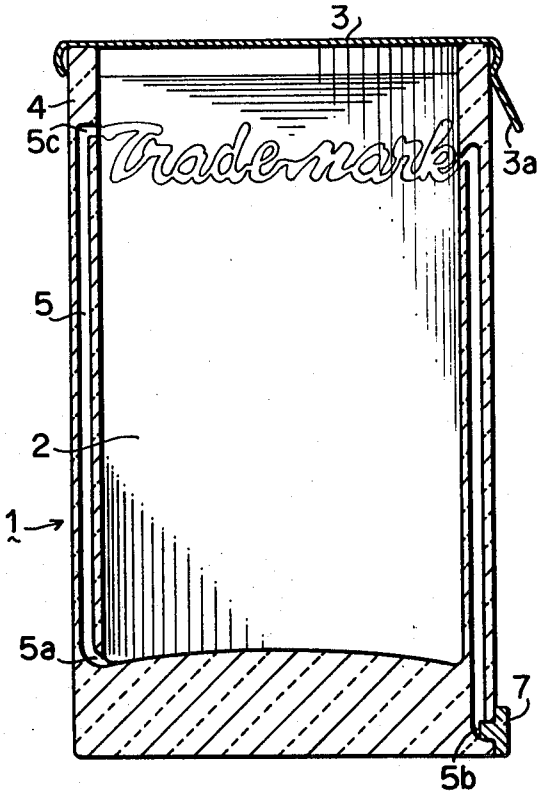
FIG. 3 is a vertical cross-sectional view of the container according to another embodiment of this invention.
Figure 2:
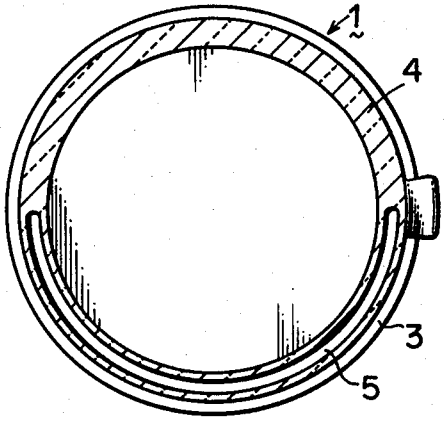
FIG. 2 is a cross-sectional view along the line A—A of FIG. 1.

FIG. 3 is a vertical cross-sectional view illustrating another embodiment of this invention. According to this embodiment, the conduit 5 of the container 1 is so formed as to display a trademark, and obviates the need of sticking a label or the like displaying a trademark onto the outer surface of the container. Further, the outlet port 5*b* may be sealed by a plug 7 instead of the seal.

As mentioned above, the container of this invention can be effectively used as a magic container even after the beverage has been consumed. Namely, after the content has been consumed, the container needs not be discarded but can be utilized as a magic container. Suppose, for example, a party going on a picnic. The empty containers of which the contents have been drunk may be collected by the leader of the picnic so that the seal or plug is taken off from the magic container, and then the party may take the lunch at the destination. Wine may be served before the lunch. Namely, the wine is poured to a level not higher than the top portion 5*c* of the conduit of the container 1. For the women, the wine may be poured in additional amounts to a level higher than the top portion 5*c*. Then, there develops such a happening that the wine starts to flow out from the outlet port 5*b* at the bottom of the container. The person served with the wine will be astonished, and the people seeing the event will burst into laughter. With the containers held by the men, on the other hand, the above-mentioned happening does not develop since the air exists in the conduit 5 no matter from which portion of the container the wine is drunk. The above-mentioned phenomenon is based upon the same principle as the city water system which utilizes the difference of the atmospheric pressure.

In this way, the container of this invention gives amusement for the people, or can be utilized as an implement for scientific experiments for the children in the primary schools and in the household. Accordingly, there exists a great probability that the containers after they have been used are not readily discarded but are preserved. This presents a good effect from the standpoint of preventing the public nuisance. Furthermore, since the conduit for displaying a trademark or the like that serves as an advertisement medium is displayed in the wall of the container, it is possible to offer a multifunctional container having a magic function and a display function in addition to the function as the container.

Although the above-mentioned embodiments have dealt with the container for containing cold beverage, it is of course allowable to contain any other beverages.

What is claimed is:

1. A container for containing a liquid such as cold beverage, said container having a peripheral wall and an upper opening for use in drinking the container contents, said wall containing a conduit which has an inlet port communicated with the interior of the container and an outlet port communicated with the exterior of the container, the inlet port being located at a position higher than the outlet port, said conduit having a rising portion which communicates with said inlet port, an uppermost portion which communicates with said rising portion and a descending portion which communicates with said uppermost portion and with the outlet port, said upper opening being closed by a cover which can be opened, and the outlet port of said conduit being sealed by a detachable sealing means from the external side.

2. A container as set forth in claim 1, wherein said conduit is formed in the wall of the container to form a medium for displaying a trademark or the like that can be seen from the external side of the container.

3. A container as set forth in claim 1, wherein said sealing means is a plug.

* * * * *